US005533911A

United States Patent [19]

Elam

[11] Patent Number: 5,533,911

[45] Date of Patent: Jul. 9, 1996

[54] ELECTRICAL CORD TO PLUG TENSION RELIEF ADAPTER AND WIRE

[76] Inventor: Zedrick T. Elam, 115-38 197th St., St. Albans, N.Y. 11412

[21] Appl. No.: 533,441

[22] Filed: Sep. 25, 1995

Related U.S. Application Data

[63] Continuation-in-part of Ser. No. 317,131, Aug. 10, 1994, abandoned.

[51] Int. Cl.[6] ..... H01R 13/58

[52] U.S. Cl. ..... 439/459; 439/470

[58] Field of Search ..... 439/456, 459, 439/457, 458, 470, 472, 473

[56] References Cited

U.S. PATENT DOCUMENTS 4,323,725 4/1982 Muller ..... 439/459
4,632,489 12/1986 Skinner ..... 439/459
4,648,680 3/1987 Gamarra ..... 439/459

*Primary Examiner*—Gary F. Paumen
*Attorney, Agent, or Firm*—Collard & Roe

[57] ABSTRACT

An electrical cord to plug tension relief adapter and wire saver/protector is provided. The invention consists of a housing containing a cam mechanism, and a universal plug seating head that is assembled and attached securely over any selected electrical cord/plug outfit at the plug end, so as to surround, bridge, and protect the joined point of connection where the plug meets the cord. A multiple pivoting cam mechanism within the housing creates an S-Shaped slotting pattern which is configured to enable the internal threading of various sizes and styles of electrical cords. The multiple cam mechanism engages and securely grips the cord when it is pulled on, and thereby creates a strengthened anchoring position where the tension force is redirected. The universal seating head is designed to encircle, accept, seat, and partially secure the selected plug end, by means of it's distinctive shape.

11 Claims, 3 Drawing Sheets

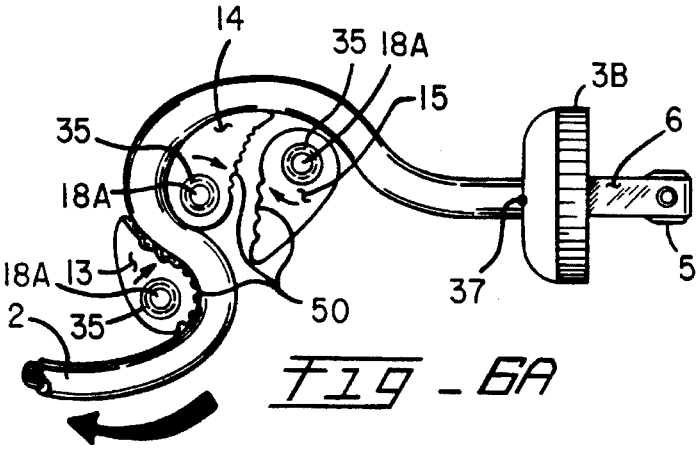
Fig - 6A
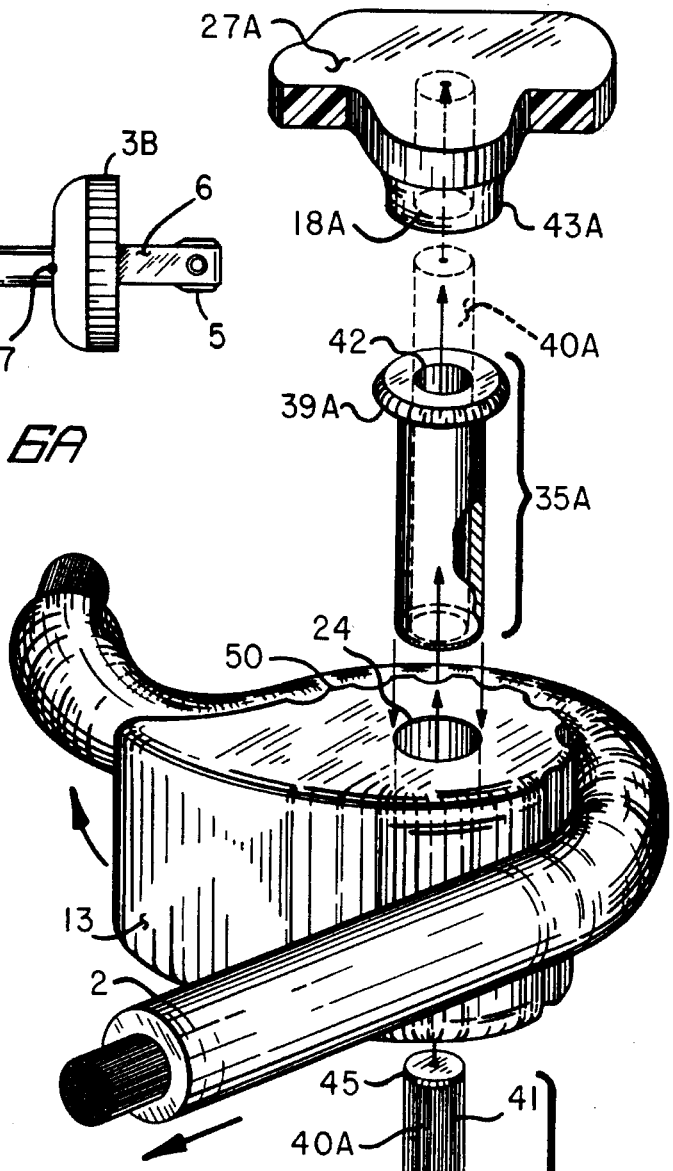
Fig - 7
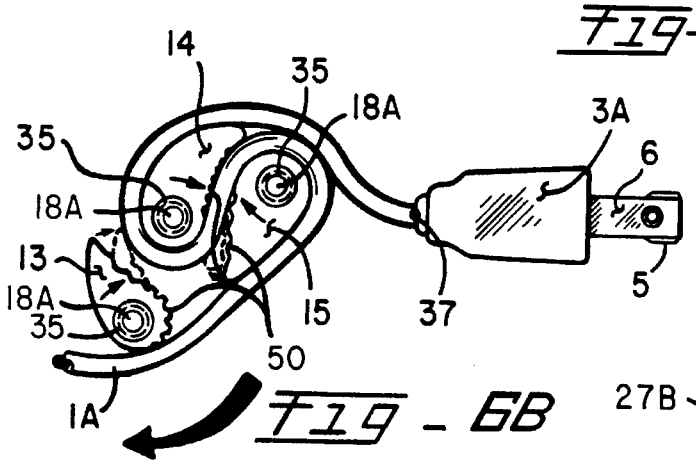
Fig - 6B
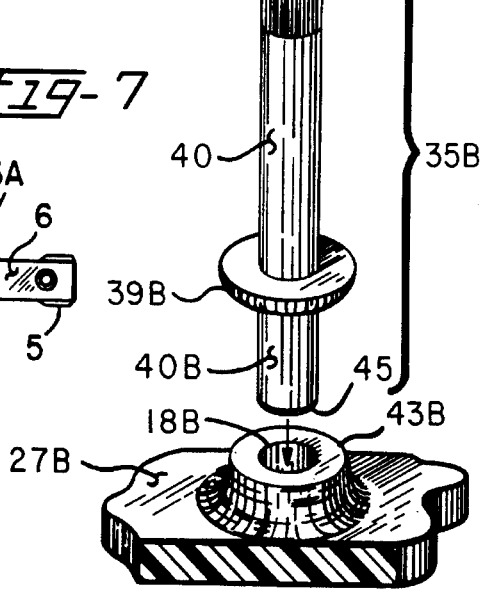

ELECTRICAL CORD TO PLUG TENSION RELIEF ADAPTER AND WIRE

This application is a continuation-in-part of U.S. patent application Ser. No. 08/317,131, filed Aug. 10, 1994, now abandoned.

BACKGROUND OF THE INVENTION

FIELD OF THE INVENTION

The present invention relates tension/stress relief devices. More particularly, it relates to a tension/stress relief adapter for electrical plug to wire connections.

SUMMARY OF THE INVENTION

The present invention provides a adapter that attaches to a plug such that the joined point of electrical connection between the electrical cord and plug is protected from stress caused by pulling on the electrical cord.

According to the invention, a housing having two halves encases the plug and electrical cord connection. The housing contains a tension relief cam mechanism which receives the electrical cord in various configurations, and which prevents the electrical cord connection between the plug and electrical cord from being subject to undue tension. The cam mechanism consists of three cams placed such that an S-shaped threading (loose and sharp) of the electrical cord can be facilitated.

The housing has a plug seating head for receiving and securing the plug within the housing. A plurality of various Harness Head Plates for various plug types further secure the plug within the housing. The housing can be comprised of plastic and includes a plurality of male and female pins for receiving each other and maintaining the housing in a closed position around the plug and electrical cord connection.

The cam mechanism utilizes a pin assembly to secure the cams within the housing and provide the necessary rotational movement thereof.

It is therefore an object of the present invention to provide a tension/stress relief adapter for electrical cord to plug connections that prevents potential breakage and damage that can occur at this point resulting from the tension force applied to it when the cord is pulled in the process of disconnecting the plug from an electrical wall outlet receptacle or socket.

It is another object of the invention to provide tension/stress relief adapter for electrical cord to plug connections that secures, bridges, and protects, the electrical cord/plug's joined point of connection and normal breakage.

It is still another object of the invention to provide a tension/stress relief adapter for electrical cord to plug connections that disperses the applied tension force created by pulling on the cord to remove the plug from the outlet, and redirects this force away from its original position.

Another object of the invention is to provide a tension/stress relief adapter for electrical cord to plug connections that can attach to any existing electrical cord to plug connection.

Yet another object of the invention is to provide a tension/stress relief adapter for electrical cord to plug connections that operates efficiently and reliably.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views:

FIG. 6A is a first embodiment of the threading configuration according to the invention;

FIG. 6B is a second embodiment of the threading configuration according to the invention;

FIG. 7 is an exploded view of a cam assembly and its components according to the invention.

DETAILED DESCRIPTION OF PREFERRED EMBODIMENTS

Figure 1:
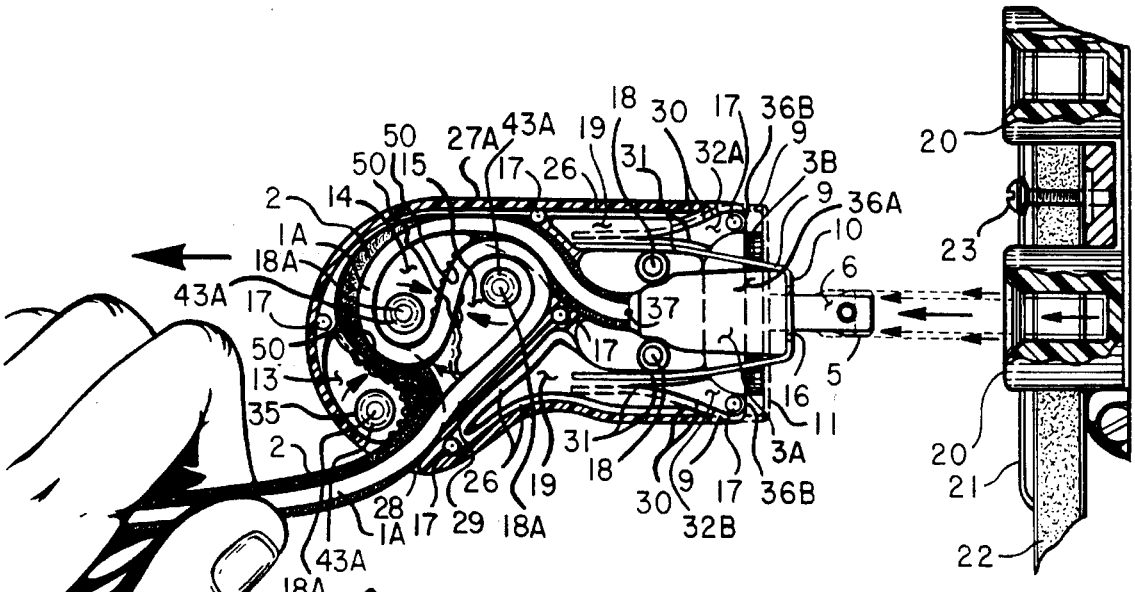
FIG. 1 is a cross-sectional view of the electrical cord to plug tension relief device according to the invention.
Figure 2:
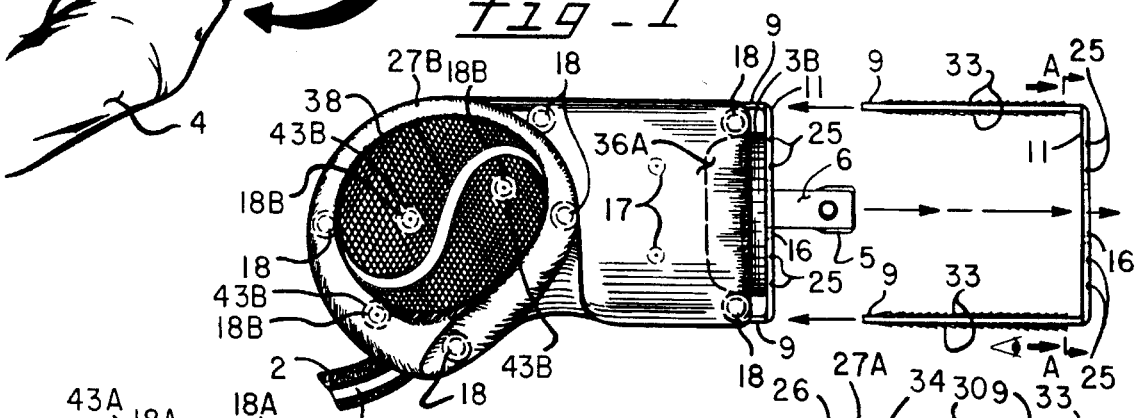
FIG. 2 is a side view of the electrical cord to plug tension relief device according to the invention.

Turning now in detail to the drawings, FIG. 1 is a side view of the left half of the preferred embodiment of the snap-case housing 27A. The case housing's left half (containing the mechanism) 27A, is aligned with, mated, and snapped together with, the right half or (empty cover) 27B (FIG. 2). The molded structure of both housing halves 27A and 27B are designed to enable the assembling and disassembling of the device around the electrical cord and plug connection. Left half containing mechanism 27A and right half 27B can be formed from a lightweight hard plastic material or any other suitable known material.

A case alignment lip 26, helps align and seat the two halves 27A, and 27B into a combined singular unit. Lip 26 is shaped to be a congruous mating element of the two halves 27A and 27B. The edges of halves 27A and 27B are molded to receive each other as guided by lip 26. Within left half 27A, lip 26 is a raised thin walled edge, having a common thickness. Lip 26 runs with the interior periphery of the case's edge, and then continues inward and throughout the casing to define the case's inner chambers. The interior periphery edge of the right half 27B is patterned into a complementary negative form of the prior (FIGS. 1, 3, and 4), and is understood to be identical to that of 27A, except functioning in the reverse.

The actual mating and secure assemblage of these two halves 27A, and 27B into a single unit, is achieved when both are aligned (by means previously noted above), and snapped to each other, through the application of these variously styled male securing pins 17, 40A and 40B. Male securing pins 17, 40A and 40B are snapped to, or permanently secured to, two basic styles of female receiving slot sets 18 and 18A, 18B, commonly shown throughout in FIGS. 1 to 4, 7, and 8.

There are a plurality (14 in preferred embodiment) (cylindrical) of male securing pins 17, 40A and 40B, having three pin styles, with differences and similarities in material make-up (either plastic or metal), appearance (either smooth or roughened with a straight knurled), diametric size tolerancing (varies amongst the two metal styles), and fit specification (different for one of the metal styles). In the preferred embodiment, there are 14 male securing pins in total.

Male securing pins 17 are formed integrally as a part of the case's interior on either half 27A and 27B. Male securing pins 17 have an equal outer diameter size and length. The surface of pins 17 is to be smooth, and their tips are to have a dull, but slightly conical point, to allow for insertion into their opposing case's female receiving slots 18. Female receiving slots being oppositely disposed from pins 17 on either half 27A or 27B of the case housing, respective to said pins.

Figure 4:
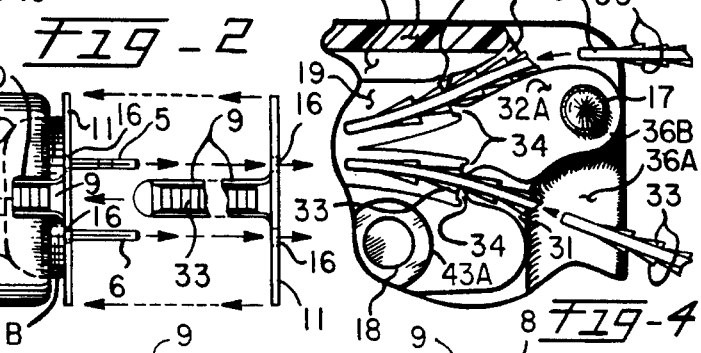
FIG. 4 is a detailed view of the universal plug seating head according to the invention.

The length of male securing pins 17 is such that upon snap-fit engagement/assembly with slot 18, there is a bottom hole clearance of a predetermined size, between the pin's tip, and the bottom depth of each slot 18. FIG. 4 shows in enlarged detail, the top view of the tip of a plastic pin 17, and one receiving slot 18.

Each pin 17 is preferable formed of plastic and is shaped and designed with a toleranced outer diameter, allowing Locational Interference Snap-Fit [Class LN2] compatibility, when inserted/snapped into one of the opposingly placed receiving slots 18. The pin shaft of each pin 17, has an outer diameter tolerance size, and fit classification type, different from those of post insertion ends 40A, and identical to those of male securing pins 40B. Mating of pins 17 with slots 18, is to be of an engaging/disengaging nature, having a somewhat snug snap/release fit that permits assemblage of the two housing halves 27A, and 27B.

There can be more than one of these identical solid metal pivot pins 35B provided and three in the preferred embodiment. The complete and total structure of each pivot pin's cylindrical shaft is comprised of three distinct, specific, and independently tolerance sized sectional elements, that form the basis of each pin shaft's diametric structure, with each serving several functions. They are to be considered as congruous parts of the whole shaft, but divided by functions, and therefore separately numbered, and described accordingly.

The pin's shaft has two singular end portion elements that are directly responsible for case assemblage/disassemblage, and one center portion element that is indirectly involved.

The center portion of each pin's shaft, called the pivot pin's—center shaft 40, is part of the basis of the pin shaft's diametric structure, of this solid metal pivot pin 35B. In relation to case assembly/disassembly, center shaft 40 section is involved, only in that it is the shaft's bridging section that runs between its two ends. It lends support to said ends of which it is a part of, and thus allows for a sort of cross gap assemblage between the case's two housing halves 27A, and 27B, upon the mating of its pin ends 40A, and 40B, to slots 18A, and 18B, respectively.

Pivot pin 35B has a post insertion end 40A, and (metal) male securing pin 40B which are each formed as one of the two singular end portion elements on the shaft of each pivot pin 35B.

Post insertion end 40A, is distinguished from the pin shaft's center 40 and other end 40B, in that it contains the pivot pin's 35B post insertion end's straight knurl 41 on its surface. Straight knurl 41 pattern is finely cut into and around the end of the pin, and proceeds approximately one quarter of the way down its shaft from the tip. Straight knurl 41 has a toleranced outer diameter (after knurling) that is equal and congruous to that of the center shaft 40. As a result of straight knurl 41, the surface of post insertion end 40A is roughened. The pin's flat ends are to have small radial chamfered edges 45, to allow for set insertion into its opposingly placed post's female receiving slot 18A. The end length of each post insertion end 40A is slightly longer than the male securing pin 17, but is equal to that of the male securing pin 40B, and (upon permanent Light Drive Force Fit assembly with the hole of each slot 18A), does not allow for any bottom hole clearance, between the end's tip, and the bottom of depth of each slot 18A.

Each post insertion end 40A is shaped and designed with a toleranced outer diameter, allowing snug Light Drive Force Fit [Class FN1] compatibility, with their matched receiving slot 18A. This designated end portion of each pin's shaft has an outer diameter tolerance size, and fit classification type, different from those of the male securing pins 17 (plastic), and the pins 40B (metal). This is because it allows for a Light Drive Force Fit with their respective receiving slots 18A, unlike the identical locational interference fits of plastic, and metal pins 17, and 40B respectively, that allow pin to slot engagement/disengagement.

Each of these three styled ends 40A, has the duel function of anchoring and permanently securing each cam 13, 14, and 15, to the case's left half 27A, and as a result of this mating's permanent nature, each post insertion end 40A also creates a steadfast support for pivot pin 35B, whose opposite/upright end (male securing pin 40B) is then free to be inserted into an opposingly placed post's female receiving slot 18B, which results in a sort of cross gap assemblage between the case's two housing halves 27A, and 27B.

Post insertion end 40A, is opposingly inserted from the end opposite shank's collar head-end flange 43A, clear through the entire length of the shank's hollow shaft through hole 42, whereupon its straight knurl 41, is inserted, press fitted, permanently mounted, and embedded snugly, into one of the three receiving slots 18A, of pivot pin anchor posts 43A.

Male securing pin 40B is the second of the two singular end portion elements on the pivot pin's shaft of pivot pin 35B. Male securing pin 40B has a smaller toleranced outer diameter than the rest of said shaft which comprises the basic structure of pivot pin 35B. The surface of male securing pin 40B is smooth, and its flat ends are to have small radial chamfered edges 45 to allow for set insertion into opposingly placed post's female receiving slot 18B. The end length of each metal pin 40B is slightly longer than pins 17, but is equal to that of the post insertion end 18A, and upon snap-fit engagement/assembly with slot 18B, does not allow for any bottom hole clearance, between the end's tip, and the bottom depth of each slot 18B.

Male securing pin 40B is separated from pivot pin's—center shaft 40, by the pivot pin's—head flange 39B, which is a single thin round flange, that has a somewhat larger outer diameter than that of the pin's shaft, and is used to prevent passage through the shank's hollow shaft through hole 42. Head flange 39B is disposed away from the pin shaft's end, along the pin's shaft, at a location one quarter of the total length of the pin's shaft, measured from said shaft's end to said flange's outer face.

Each pin 40B is shaped and designed with a toleranced outer diameter, allowing Locational Interference Snap-Fit [Class LN2] compatibility, when inserted/snapped into one of the opposingly placed receiving slots 18B. This designated end portion 40B, of each pin's shaft, has an outer diameter tolerance size, and fit classification type, different from those of post insertion ends 40A, but identical to those of the plastic pins 17. Mating of pin 40B to slot 18B is of an engaging/disengaging nature, having a somewhat snug snap/release fit that permits assemblage of the two housing halves 27A, and 27B.

The plurality of round female receiving slots 18, 18A, 18B, are defined by the toleranced inner diameter of their base hole, which is maintained as being equal to each other, and not varying. There are an equal number of female receiving slots 18, 18A and 18B corresponding to the total number of male securing pins 17, 40A (post insertion end), and 40B. This base hole size will be relied upon as being the base calculation factor, that determines the basis of the varied male securing pin's two outer diametric sizes, as well as their complementary pin-to-slot fit classifications. This rule is to remain constant, even though each is specified for one of the three specific functional uses that each pin represents; uses that vary with, and pertain to, the matched type of pin they accommodate. All of these slots are found incorporated into two basic styles of molded plastic structural formations, that are present within the unit's case. These slots are shown and identified as follows:

The first style of slots, called case's slots, consists of eight of slots, which are designated case female receiving slots 18. Each slot 18, maintains a hole that has a toleranced inner diameter, that allows for the same complementary fit as previously defined for the case's male securing pin 17 (of which it is placed to receive). Slots 18 are molded flush to the case's interior, with its depth set into either the case's solid walls, its dividing channels, or its alignment lips. These slots 18 are strategically placed throughout the case's interior, and are used for the engaging/disengaging acceptance of the eight opposingly aligned, and size matched, male securing pins 17. Male securing pins 17 are molded onto the inside form of both case housing halves 27A and 27B. The case's female receiving slots 18, are positioned at staggered locations where they will reversely complement their male counterparts in numbers and placement, insure a snug mating fit, and prevent separation of the case halves during use. These designated locations are commonly shown throughout in FIGS. 1–4, and are specified as follows:

In referring to the location of the case's eight female receiving slots 18, two of them are seen located on the case's left half 27A, and six are on the right half 27B. In reference to the right half 27B—four of them are molded into, or next to, the case alignment lip 26; and two of them are in the upper and lower slot's dividers 32A and 32B on Universal Plug Seating Head Rim 36A (both of which are defined and described further on in this description). In reference to the left half—two of them are centrally situated near where the cord/plug's joined point of connection and normal breakage 37 will be located. Although shown in designated places, slots 18 and pins 17 can be located according to design specifications.

The second style of slot's, called post's slots, consist of six slots, which are grouped into two identical sets of three, identified as slots 18A and 18B.

These six post's slots 18A, and 18B, are formed atop, and centrally set into, six slightly raised round plastic surface bosses 43A and 43B, which encircle the hole with a thin outer wall shell, that rises from the case's inner surface. With the slot included, each boss resembles a hollow post, for which the name post's slot is given.

These six posts are also grouped into two sets of three, with each post's set, containing one specific slot set of three. The receiving slots 18A, and 18B, are to be opposingly placed and aligned to each other, so that each in-line slot receives one of the two, correctly designated and matched ends of each of the three metal pivot pins 35B. Thus, the unit's case is designed so that one identical grouped set of three posts, is molded to the interior structure of the case's left half 27A, and functions as both the cam's axial position, and pivot pin anchor post 43A (containing post's female receiving slots 18A). These three post's female receiving slots 18A are placed to receive, and permanently embed the post insertion ends 40A. Each post's slot 18A, maintains a hole that has a toleranced inner diameter, that allows for the same complementary fit as previously defined for the end 40A.

The other identical grouped set of three posts, is molded to the interior structure of right half 27B, and functions as both the cam's axial position, and pivot pin support post 43B (containing post's female receiving slots 18B). These three post's female receiving slots 18B, are placed to receive the metal male securing pins 40B. Each post's slot 18B, maintains a hole that has a toleranced inner diameter, that allows for the same complementary fit as previously defined for pin 40B.

It is here at these post's slot locations, that the two styles of metal securing pins 40A, and 40B, respectively double as both a pin to slot securing component features (as described), as well as the cam's axial pivot pin positioning anchors and support pins.

Each post's slot location is defined by the tension/strain relief mechanism (hereinafter referred to as the Tri-Gripper Cord Securing Mechanism) placement within the unit, which determines its three cam's designated axis positions. Thus, post's slots 18A and 18B are specifically placed and spaced in a somewhat elongated triangular pattern that occupies the three basic pivotal positions of the three pivoting cams (described below in greater detail under the internal mechanism description).

This matching of each post's slot to each post insertion end 40A, and each male securing pin 40B, sets the position of the solid metal pivot pin 35B. This matching also sets and fixes the opposing location of these two metal pivot pin end styles, their respective post's slots, and their posts, since they are all related to the opposing ends of the same pins. As a result of this, each pivot pin 35B serves a triple function. They are used as each cam's pivot axis, plus they provide one end which permanently anchors itself by means of its metal pivot pin's—post insertion end 40A, while at the same time, supplying a second end which functions as a temporary support for the purpose of engagement/disengagement of each metal pivot pin's end—metal male securing pin 40B.

Figure 3:
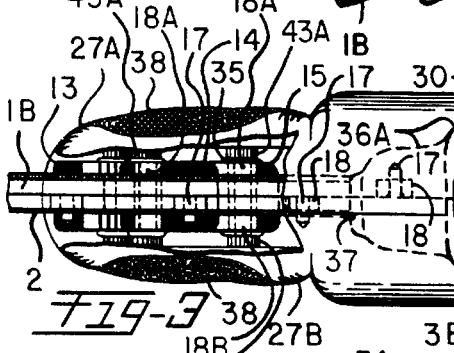
FIG. 3 is a top view of the electrical cord to plug tension relief device according to the invention.
Figure 8:
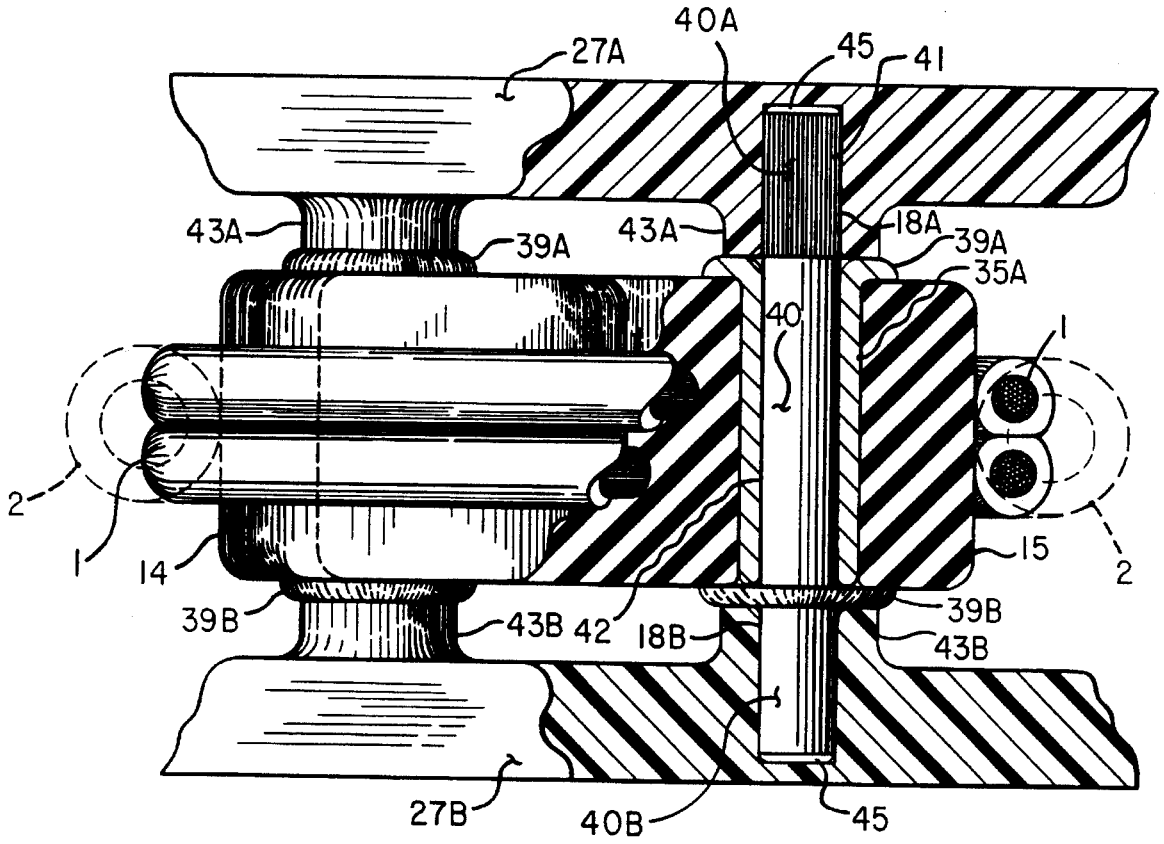
FIG. 8 is a partial cross-section of a cam and pivot pin arrangement in relation to a second cam according to the invention.

The inner case locations of both case and post styles of female receiving slots 18, 18A, and 18B, plus the same on-spot/in-line locations of the three types of male securing pins (i.e., male securing pins 17, post insertion end 40A, and male securing pins 40B), can be viewed most clearly by referring to FIG. 1, and also FIGS. 2, and 3 where they are indicated by hidden lines. FIGS. 7, and 8, most clearly show through enlarged views of one metal pivot pin arrangement 35, and all its included elements, with a complete set of both metal securing pins 40A and 40B, relative to their respective post's receiving slots 18A, and 18B, and as both disengaged and engaged. A magnified view of one case's female receiving slot 18, and one plastic male securing pin 17 can be seen in FIG. 4.

To complete the description of the case's structure is the diamond knurl—raised hand-grip pattern 38, which is a common exterior snap-case feature, clearly shown to be present on both housing halves 27A and 27B in FIG. 3. It is shown molded onto the outer surface of the unit's molded case—right half (empty cover) 27B, and understood to be present on the unseen side of molded case left half (containing mechanism) 27A in FIG. 2. It is also understood to exist on the reverse side of 27A in FIG. 1, even though it is unseen. This molded surface pattern creates a rough surface that prevents slippage when the unit's case 27A and 27B combined, is grabbed by a person's hand 4.

In addition to case structure, FIG. 1 continues by showing in detail, the second of unit's basic initial features, the internal Tri-Gripper Cord Securing Mechanism, illustrating it to be comprised of a strategically placed, somewhat elongated triangular pattern arrangement of three individually sized/shaped hard rubber gripper cams 13, 14, and 15. Each cam is utilized as a cord friction/pressure gripper, and is supplied with a rough striated clamping surface that forms a ridged gripper 50 on their inward side.

The Outer Slot Cam—Cord Gripper 13, the smallest cam, has a smooth slightly curved back with broad ridges molded along its slightly curved inward facing side, which are to proceed approximately three quarters of the way around its pivot curve.

The Central Slot Cam—Cord Gripper 14, is the longest cam, and also has a smooth curved back, but unlike cam 13, it has a substantially greater curve to it, and has finer ridges molded along an equally curved inward facing side.

The Inner Slot Cam—Cord Gripper 15 is slightly wider across its pivot diameter, and not as long as Cam 14. Cam 15 is to have the least amount of curvature to its smooth back, and contain broad ridges along its somewhat straight inward side.

All three cams are to contain an identical axial pivot pin through hole 24, at their pivot point locations. It is here, that each cam is placed upon, is pivotally mounted to, one of three identical (cylindrical) metal pivot pin arrangements 35. The pivot pin arrangements 35 are each composed of two specially designed, and complementary stainless steel alloy pieces, which are separately formed as individual pieces, by a combination of cold heading and machining processes. These pieces are then made to function in unison, and are specifically added to each cam for the purposes of enabling pivotal movement, and permanent securing of each cam within the unit's case.

The first of these two pieces is a thin metal pivot pin's—hollow collar shank 35A, and is similar to a long metal eyelet (FIGS. 7, and 8). It is press fitted into, and inserted through, each cam's axial pivot pin through hole 24 from the cam's left side. The shank's hollow shaft 35A is designed with a toleranced outer diameter, allowing Locational Interference Fit [Class LN2] compatibility with the interior diameter of cam's axial pivot pin through hole 24.

On one end of each shank 31A, is a single collar head flange 39A having an outer diameter greater than that of the through hole, said flange preventing passage through the cam's body. Collar head flange 39A also serves to hold the three rubber cam grippers 13, 14, and 15 in place, with each allowing for collar support of their respective pivot pins. The length of the hollow shaft shank 35A (which runs from the underface of the shank's collar head—end flange 39A, to the shank shaft's tip) is equal in length to the body thickness of each cam 13, 14, and 15 (through which it passes).

The entire shank's structure is formed of the shank's thin metal shaft casing, having a length that runs from the shank shaft's tip to the outside of the shank's collar head-end flange 39A. The shank's hollow shaft through hole 42 (FIG. 7), centrally runs through the entire length of the metal pivot pin's hollow collar shank 35A. Hole 42 is designed with a toleranced inner diameter, allowing Close Running Clearance Fit [Class RC4] compatibility with the outer diameter of the inserted metal pivot pin's—center shaft 40 (a tolerance sized sectional element, defined as the center portion of the second piece provided—the solid metal pivot pin 35B).

The second piece of pivot pin arrangement 35 is this solid metal pivot pin 35B (designated piece #2 of 2 of pivot pin arrangement 35), of which three are provided. These three pins share a basic size commonality of all elements present on their pin shaft, including the diametric structure of their pin's three independently tolerance sized sectional elements 40, 40A, and 40B, its two ends with radial chamfered edges 45, and the single head flange 39B, all of which have previously been described pertaining to the two styles of metal securing pins.

The complete pivot pin arrangement 35—inserted pin shaft (40 and 40A), is the portion of the shaft running below inner face of the pivot pin's—head flange 39B, and is composed of the center shaft 40, and its congruous post insertion end 40A. Both these elements are designed with the same toleranced outer diameter, allowing Close Running Fit [Class RC4] compatibility with the inner diameter of the shank's hollow shaft through hole 42, of whose interior surface is made to specifically receive, and interact with, the outer diameter of center shaft 40. This outer diameter enables the pivot pin's—inserted pin shaft, to be opposingly inserted, from the end opposite the shank's flange 43A, (now on the cam's right side), into, and clear through, the entire length of the shank's hollow shaft through hole 42.

Once combined, the two pieces become the metal pivot pin arrangement 35, and as a single component, supports itself through the prior attachment of hollow collar shank 35A to the cam. Each of these three combined arrangements 35, is then permanently secured to the case's left half 27A, by its own post insertion end 40A having the straight knurl 41 surface, which is press fitted into post's female receiving slot 18A.

Each of these three pivot pin arrangements 35 serves as one of three cam gripper's strategically placed pivot axis pins and support posts, as well as one of three metal male securing pins 40B. As discussed earlier, pins 40B are aligned to join with the three opposingly positioned post's female receiving slots 18B, on the case's right half 27B. These three pins are identical, and are provided, to hold the three rubber cam grippers 13, 14, and 15, in place, with each allowing for pivotal movement within the shank's hollow shaft through hole 42.

Once all three cams 13, 14, and 15 are secured by a pin, they become an unremovable part of the case's left half 27A. This enables all three metal pivot pin arrangements 35, to serve as both strategically placed permanent axis positioning pins (as described), and also utilize their other pin ends (on the flange side) as engagable/disengagable metal male securing pins 40B. These ends are placed in line to join with the three opposingly positioned slightly raised plastic female receiving slots 18B, located on the case's right half 27B. This insertion completes the snap assemblage of the unit around the electrical cord once it has been selected and specially threaded within the unit.

FIG. 1, through the use of a composite drawing, that illustratively combines interchangeable overlaid images to depict the interaction of the Tri-Gripper Cord Securing Mechanism, which has two various design configurations, that help to translate and define the universality of the unit's functions, in relation to the variation and abilities of the unit's adaptive parts. Knowing the structure of this mechanism's components was the first step to understanding how their relationship to these other components, functions, features, and abilities, enable them to work in unison to aid in their progression towards achieving their purpose and goal.

Before describing the mechanism's abilities, a complementary feature of the invention must be defined, and illustrated. This is done in FIGS. 1 and 6, by depicting the function known as Electrical Cord Threading, which is to be understood as a primary design aspect, whose bent S-Shape, originates from the patterned layout and spacing between the cams, as defined by the S-Shaped cord threading channel 29.

FIG. 6*a* shows the sharp S-Shaped threading configuration 44A, and FIG. 6*b* shows the loose S-shaped threading configuration 44B.

These two S-shaped threading configurations 44A, and 44B, each differ somewhat in the channel direction, but are found to be identical in their inherent response to axial cord movement, and in promoting the physical force that facilitates the mechanical pivotal movement of the Tri-Gripper Cord Securing Mechanism's cams 13, 14, and 15. Two threading shapes 44A and 44B, when properly formed and secured, effectively help to increase the cord's applied tension resistance to axial pulling forces.

One benefit resulting from the primary purpose of this threading, is achieved by the internal bundling and rigid curving that is applied to form the electrical cord into a strong S-Shape Threading Configuration 44. Once the cord is interwoven around, passed between, and contained by the cams, this now bundled and condensed group, is further solidified when it is restrained within the confines of the unit's case. This bundling of the cord with its cams, adds to create a compact, stronger, and more tension resistant form, respective of the selected patterned threading course it creates, and due on its own part, to its constraining shape, and the pressure the cams apply. Once secured, the engagement of cams and gripped cord become a strengthened anchoring position and new tension focal zone, to which the tension force created at the cord/plug's joined point of connection and normal breakage, can be redirected to, and now concentrated at.

One must first select and utilize the appropriate one of these two distinct S-Shaped Threading Configurations, either the sharp S-Shaped Threading Configuration 44A, or the loose S-Shaped Threading Configuration 44B. This decision is determined by matching the cord/plug outfit they wish to protect, to its corresponding threading pattern.

Figure 5A:
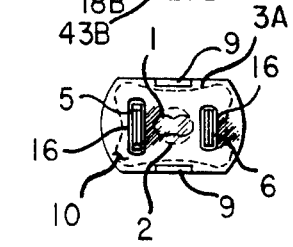
FIG. 5A is a first embodiment of a harness head plate according to the invention.
Figure 5B:
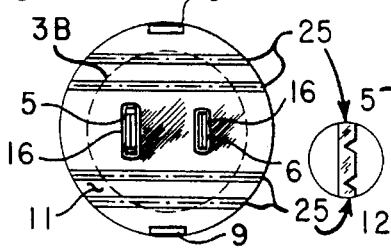
FIG. 5B is a second embodiment of the harness head plate according to the invention.
Figure 5C:
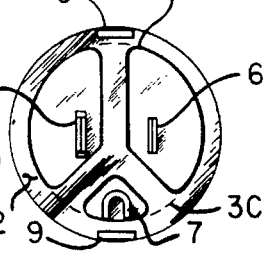
FIG. 5C is a third embodiment of the harness head plate according to the invention.

Depicted in FIG. 1, is a composite overlay, showing two of the several possible variations showing the Tri-Gripper Cord Securing Mechanism's adjustment to, acceptance of, and interaction with, two different sizes/shapes/styles/types of electrical cords and attached electrical plugs, that can be matched respectively, to each of the two distinct forms of S-shaped cord threading. FIGS. 6*a* and 6*b* show separate composites of the overlay for clarity. Electrical cord 1A is a flat 2 wire electrical cord, and electrical cord 2 is a Round Wire. FIGS. 5A–5C show the plugs to be either a small rectangular 125 V electrical plug 3A, a round 125 V electrical plug 3B, and a round 220 V electrical three-prong plug 3C.

It is to be understood that only one cord and one plug combination is to be utilized at a time, even though various combinations are illustrated to be possible. Therefore in order to distinguish between the various combinations, solid drawing lines are used in FIG. 1, to represent and indicate the use of the small rectangular 125 V electrical plug 3A seated in the Universal Plug Seating Head 36A, being held in place by its matched Rectangular Harness head plate 10, and secured with harness securing cable/straps 9, while dashed drawing lines are used to represent a different plug (in this case) the round 125 V electrical plug 3B, shown seated in the same Universal Plug Seating Head, held in place by its matched Adjustable Harness Head Plate 11, and secured with harness securing cable/straps 9.

The Sharp S-Shaped threading configuration 44A (FIGS. 1 and 6B) is used for the various sizes of common 2-Wire Flat Electrical Cord of varying gages. In the preferred embodiment, 16, 18 or 20 gage wire can be used. FIG. 1 shows cord 1A entering the unit's case 27A, at the cord insertion opening 28, and following the S-Shaped cord threading channel 29, that interweaves around and between the gripper surfaces of all three hard rubber pivoting cams 13, 14, 15. These cams form the basis of the Tri-Gripper Cord Securing Mechanism (previously described), which defines through its own layout, the two distinct S-Shaped threading channel patterns that develop around and between its three gripper cams. Its pivoting cams are spaced such that they can adjust to, and singularly accept, the properly threaded cord in a pattern that corresponds to the S-Shaped configurations it creates.

The Loose S-Shaped Configuration 44B, which is to be independently utilized apart from its counterpart described above, is shown in FIGS. 1 and 6A. It is used for various sizes of common round wire electrical cord 2. In the preferred embodiment of the invention, electrical cord 2 is no larger that 16 gage. Cord 2 enters the unit's case 27A at the same cord insertion opening 28, but then follows a course that takes it around past one cam gripper's surface 13, and up and over the curved backs of the other two cams 14, 15.

The mechanism of cam grippers 13, 14, and 15 to automatically engage and friction-lock against electrical cord 1A, 1B, or 2 (FIG. 1), in response to said cord being pulled by a person's hand 4, is shown in the process of removing the plug from an electrical wall outlet/receptacle. Through the use of this same composite and interactive drawing FIG. 1, we observe the interchangeable overlaid images depicting two different scenarios of possible interaction referring to component assemblage, and illustrating how the unit can singularly utilize either one of the two different styles of electrical cord/plug outfits.

FIG. 1 shows the small rectangular 125 V electrical plug 3A, or the round 125 V electrical plug 3B, being used with either electrical cord 1A, or 2, each of equal adoptive substitution. Although both are shown seated in their respective positions within the Universal Plug Seating Head 36A, each is to be used and considered independently of one another, and viewed here only as an example of their being selectively interchangeable.

This however differs in FIGS. 2, and 3, since only the round 125 V electrical plug 3B is shown adopted, to demonstrate plug seating and securing in relation to the Universal Plug Seating Head 36A, and its respective harness head plate.

In order for the invention to serve its goal, the unit must not only contain and secure the cord, as previously described, but it must also secure the plug, in order to prevent its slippage and dislodgment from said unit. This is achieved through the use of the Universal Plug Seating Head 36A (FIGS. 1, 3 and 4).

This is the inner front part of the unit's molded case 27A, 27B (combined), that is encircled by its own circular rim, designated universal plug seating head rim 36B, and continues inward into the unit to take shape as a molded free-flowing sequence of inner surface forms, that mirror the reverse/negative impressions of the rear portions of several common electrical plug's sizes/shapes and styles. Its designed purpose is to accept, seat, and partially secure these various sized/shaped and styled electrical plugs, in conjunction with the further shrouded securing process that takes place through the use of a selected harness head plates of FIGS. 5A–5C.

Once the electrical cord has been threaded, the electrical plug's rear is then set into its closely matched reverse/negative impression, which is present on the inner surface of the Universal Plug Seating Head 36A. The two halves of the unit's case 27A, and 27B are aligned by case alignment lip 26, and then snapped shut around the cord/plug outfit leaving its plug seated and partially secured within, and the electrical cord emerging from the unit's case at the cord insertion opening 28.

FIGS. 5A–5C show three embodiments of harness head plates 10, 11, and 12, which secure the selected plug to the Universal Plug Seating Head 36A. Harness Head Plates 10, 11, and 12, each have two arness securing cable/straps 9. They are illustrated in FIG. 1, 2, and 3, with magnified details of securing components and workings shown in FIG. 4, and surface details of Harness Head Plates 10, 11, 12 shown in FIGS. 5*a*, 5*b* and 5*c*, respectively.

FIG. 2, in particular, uses a side view to illustrate the preliminary positioning of selected Adjustable harness Head Plate 11 (See FIG. 5*b*), to the universal plug Seating Head 36A, by showing it with its two harness securing cable/straps 9, aligned and detached, as well as fully secured. Harness Head Plate 11 is used to secure the round 125 V electric plug 3B, by inserting the plug's polarity prong 5, and non-polarity prong 6, into the two-prong cutout slots 16, and then slipping both harness securing cable/straps 9, into the two designated upper harness securing slots 30 (used for this plate style/size), of the Universal Plug Seating Head 36A.

FIG. 3 depicts the same singular design configuration shown in FIG. 2, except the unit and harness attachment are shown from the top view.

FIG. 1, in accordance with two different plugs, their complementary cords, and representative of the two possible threading configurations, also depicts the utilization of two different styles of the three available harness head plates. These are the Rectangular Harness Head Plate 10 (shown in solid lines)(see FIG. 5A), used to secure the 125 V small rectangular electrical plug 3A, and the Adjustable Harness Head Plate 11 (shown unfolded and fully opened, in phantom lines)(see FIG. 5B), used to secure the round 125 V electrical plug 3B.

This final procedural phase of the cord/plug outfit's adaption, adoption, containment, and total securing to the unit, is accomplished by using one of the three different styled/shaped thin high strength Nylon Harness Head Plates 10, 11, and 12, to surround, shroud, and secure the seated and partially secured plug to the Universal Plug Seating Head 36A. The thickness of harness head plates 10, 11 and 12 is of critical importance and is disclosed in the preferred embodiment as being no greater than 1/16". This is to allow for the closest possible fit between the plug face, and the face of electrical duplex wall outlet/receptacle or socket 20. This parameter is necessary to permit good plug to outlet/receptacle or socket connection, and is to prevent dislodgment of the plug, due to inadequate prong engagement. This will also allow each plate to serve its purpose, while still maintaining its rigidity and structural integrity.

Although harness head plate variations are evident in their design as shown in FIGS. 5A–5C, certain commonalities are present in all three Harness Head Plates and their cable/straps 9 arrangements. Harness Head Plates 10 and 11 have centered two-prong cutout slots 16, while plate 12 has a three-prong Wide-Y cutout pattern 8, either of which allows for the through insertion of the electrical plug's prongs 5, 6, or 7 (located at plug's front). All harness head plates also have two harness securing cable/straps 9, which are structurally molded opposite, and parallel to each other (FIG. 2), and which are centrally located on the periphery of each plate's edge (above and below the two-prong cutout slots 16, or the three-prong Wide-Y cutout pattern 8). These two cable/straps 9 are to project out at right angles from each plate's face, and individually have slightly raised, molded surface ridges 33, on both sides of the flat strap's surface. These surface ridges 33 form, and are to be of, a self-locking pattern nature, similar to those found on standard/existing Nylon cable ties. One of these cable/straps is presented in a top view in FIG. 3, and shown in an enlarged side detail in FIG. 4, as the harness cable/strap's self-locking ridges 33.

FIG. 4 proceeds in depicting through an enlarged detail, the upper section of the Universal Plug Seating Head rim 36B, which comprises the front top portion of the unit's molded case—left half (containing mechanism) 27A. In addition it shows how one of the Harness Securing Cable/Straps 9 (the one that is to be placed above the plug) can be inserted into either the upper harness securing slot 30, or the lower harness securing slot 31. Also shown is how the harness securing Cable/Straps 9 are inserted into the selected Harness Securing Slots, and secured in place by the Harness Cable/Strap's self-locking ridges 33, and the Harness Cable/Strap's pressure snap-locks 34 contained in half 27A and which wedge against ridges 33.

In order for the selected harness head plate and augmenting Harness Securing Cable/Straps 9 to be secured to the universal plug head 36A, said Harness Securing Cable/Straps 9 are placed across the top and bottom of the electrical plug (either 3A or 3B), positioned, and then slipped into one matching pair of the four molded securing slots 30 or 31, which are located on the universal plug Seating Head Rim 36B, at the front of the unit's molded case 27A, and 27B combined.

Each pair of the four securing slots 30, and 31, represents one set of two matching outer harness securing slots 30, and one set of two matching inner harness securing slots 31. Each set is defined by its placement on the Universal Plug Seating Head rim 36B. The two slots that fall outside the rim are designated Outer Harness Securing Slots 30, while the two below the rim are called Inner Harness Securing Slots 31. Within the inner structure of the unit's molded case 27A, and 27B, are two slot dividers, each of which serve to separate one outer slot 30, from one inner slot 31. These dividers are both shown as part of the rim, in positions above and below the seated plug (either 3A or 3B). The divider above the selected plug is designated upper slot's divider 32A, and the divider below the selected plug lower slot's divider 32B.

The upper slot's divider 32A, is shown in FIG. 4, which depicts this procedure through an enlarged detail of the front top portion of the unit's molded case—left half (containing mechanism) 27A, and showing both selective means of the Harness Securing Cable/Strap 9 insertion into their respective Outer Harness Securing Slot 30 or the Inner Harness Securing Slot 31. Note that even though both selective possibilities are shown, only a singular use for this procedure, is to be applied, and is implied.

The choice of slot selection is determined by, and depends on the style and diameter size of the harness head plate used. FIGS. 5A–5C show the three various styles and sizes, illustrated as Plates 10, 11, and 12. These selective components are to be used as follows: For Small Diameter Harness Head plate 10, or for adjustable Harness Head Plate 11 (with its plate face folded and closed to its smaller size) Inner Harness Securing Slots 31 are used. As shown, Cable/Straps 9 are inserted into the two slots below the Universal Plug Seating Head Rim 36B; For Large Diameter Harness Head Plate 12, or for Adjustable Harness Head Plate 11 (with its face plate unfolded and opened to its larger/full size), Outer Harness Securing Slots 30 are used. As shown, Cable/Straps 9 are inserted into the two slots above the Universal Plug Seating Head Rim 36B.

Upon insertion into the slot, each of the two Harness Securing Cable/Straps 9 have their Harness Cable/Strap's Self-Locking Ridges 33 slid into contact with the Harness Cable/Strap's Wedged-Shape Pressure Snap-Locks 34, located within the Slots. These pressure snap-locks 34 set themselves against, and force their wedged-shapes into the corner surfaces of the molded/ridged self-locking pattern of the Harness Cable/Strap's Self-Locking Ridges 33. There are eight Harness Cable/Strap—Wedge Shaped Pressure Snap-Locks 34, that form four pairs of locks, allowing for one pair per each of the four Securing Slots. This results in the placement of one lock on each ridged surface side of the two Cable/Straps 9 used, and for whichever pair of slots selected. After passing the locks 34, the ends of the two Cable/Straps 9, are led-in from the Outer and Inner Harness Securing Slots 30, and 31, whereupon they extend into two Hollow Harness Cable/Strap Receiving Chambers 19, molded into the interior structure of both halves of the unit's snap-case 27A, 27B, above and below the rear of the Universal Plug Seating Head 36A, between it and the Tri-Gripper Mechanism.

The device as described utilizes the action of pulling on the electrical cord to actually reduce and alleviate the tension force between the cord and the electrical plug. This is achieved this by directing and transferring the tension force along the Harness Securing Cable/Strap 9 to the Harness Head Plate, where this redirected force that has bridged and circumvented the connection point between the cord and plug is now changed from a pulling force to a pushing force, that applies an extra counteracting pressure against the front of the plug, whenever the cord is pulled. This force helps to push the plug from the electrical duplex wall outlet/receptacle or socket 20, without harming the electrical cord/plug—point of connection and normal breakage 37.

FIGS. 5A, 5B, and 5C depict the surface details of the three various styled/sized Harness Head Plates 10, 11, 12, that are to be supplied with the unit as part of a Interchangeable and Adaptive Part's Kit. This Kit containing these three basic Harness Head Plates, will allow for varied plug selection and universal adaptability of the unit, when developed, produced, and marketed. It is to be considered open to the inclusion of other specifically designed adaptable Harness Head Plates and/or accompanying pieces, and can be expanded upon in the future (if needed) to meet the needs of specialty or newly designed plug shapes.

Electrical plugs 3A, 3B, and 3C represent just three of the variety of possible electrical plugs that can be individually seated in the Universal Plug Seating Head 36A. Although 125 Volt electrical plugs (for American currents of 110 V–120 V) are indicated and illustrated throughout as being the standard preferred for adaptive use of the invention, this is not to be accepted as a limiting or exclusive factor when it comes to its broad adaptive utilization and capabilities. Thus, Harness Head Plates for every type of plug can be formed according to the invention.

Consideration of the invention's use with 220 Volt electrical plugs (for Foreign currents) is also noted, as feasible and possible, as long as the selected electrical plug (be it 125 V or 220 V) is of a size and shape that can be seated in the Universal Plug Seating Head 36A, and be secured by one of the three provided Harness Head Plates 10, 11, or 12 (below), or by other customized plates not shown.

The (small) Rectangular Harness Head Plate 10 (FIG. 5*a*) is a plug securing plate preferably made of thin high strength nylon (1/16" thick), and slotted for a small rectangular 125 V electrical plug 3A.

The (round/rectangular) adjustable harness head plate 11 (FIG. 5B) is a plug securing plate made of high strength nylon (1/16" thick), and slotted for a round, or small/large rectangular 125 V electrical plug styles 3B or 3A, or any unspecified larger rectangular plugs available. The surface of Harness Head Plate 11 is provided with a folding feature capability, formed by four molded V-Line fold hinges 25 scored into the surface of its plate. The magnified detail of 25 is shown next to the view of Adjustable Harness Head Plate 11. These fold hinges are used to allow for shape/size adjustment when needed. They are folded/or not, to match the plate size, to the rectangular size or diameter of the plug selected. When folded to its smallest rectangular size, this Plate 11 can be used in place of Plate 10.

The (round) Universal Wide-Y Harness Head Plate 12 is a plug securing plate made of high strength Nylon (1/16" thick), that contains a Three Prong Wide-Y Cutout Pattern 8, which is the necessary slotted design form needed to accept the myriad of round three-prong electrical plug styles that are available and have been produced. Unlike two-prong plugs, three-prong plugs can show a more varied design in the shape and positioning of their prongs, and therefore need a greater range and wider slot cutout area allowing for a greater prong positioning and flexibility factor.

FIG. 1 shows how a person's hand 4, supplying pulling tension movement (indicated by curved arrow) on the electrical cord 1A or 2, sets into motion the applied tension force to the Tri-Gripper Cord Securing Mechanism, and thus causing said mechanism's cams to grip the electrical cord 1A or 2. This in turn alleviates the applied tension from the electrical cord/plug's joined point of connection and normal breakage 37. In addition the pulling action supplied, sets up a chain of counter forces that are redirected from the Tri-Gripper Cord Securing Mechanism into the body of the unit's case at the Universal Plug Seating Head 36A, which then transfers it along the Harness Securing Cable Straps 9 to the Harness Head Plate 10, 11, or 12, where a reverse pushing motion supplies pressure to the prong face of the plug. This results in the aided dislodgment of the plug (as indicated by parallel motion arrows) from the electrical duplex wall outlet/receptacle or socket 20, which is illustrated as a standard duplex(two prong) outlet/receptacle, setup and accompanied facilitating reference parts—electrical outlet plate 21, and electrical wall outlet plate screw 23, and mounted into a Gypsum wallboard 22.

As intended, the securely gripped cord now becomes the central locational zone subjected to the pulling tension and thus prevents separation and breakage damage to the cord/plug adapter point.

While several embodiments of the present invention have been shown and described, it is to be understood that many changes and modifications may be made thereunto without departing from the spirit and scope of the invention as defined in the appended claims.

What is claimed is:

1. An electrical cord to plug tension relief adaptor and wire saver/protector comprising:

a housing having a first half and a second half releasably connected with each other, said first and second halves having a front, a back, opposite sides, an internal chamber, and edge surrounding said internal chamber, and an exterior, one of said halves having an alignment lip disposed along said edge for enabling the alignment of said halves for coupling;

a tension relief mechanism disposed within the internal chamber of said halves of said housing, said tension relief mechanism for receiving the electrical cord and preventing disconnection between the electrical cord and plug caused by increased tension/stress at a point of connection between the electrical cord and plug, said tension relief mechanism comprising:

a plurality of support posts disposed in one of said two halves of said housing;

a plurality of female receiving slots disposed directly opposite said plurality of support posts in the other of said two halves of said housing;

pivot means coupled to said plurality of support posts and said plurality of female receiving slots; and a plurality of cams pivotally mounted on said pivot means, each of said plurality of cams having a top, a bottom, an outer edge, and an axial through hole for receiving said pivot means and enabling the rotation of said cams about said pivot means; and securing means releasably coupled to said housing for securing the plug and electrical cord within said housing.

2. The electrical cord to plug tension relief adaptor and wire saver/protector according to claim 1, wherein said housing further comprises a cord insertion opening in the back of said halves, a plug seating head disposed in the front of said halves for receiving the plug, a plurality of securing pins formed within one of said first and second halves of said housing, and a plurality of receiving slots formed within the other of said first and second halves, said securing pins and said receiving slots being oppositely disposed in said housing halves such that said housing halves are releasably snapped together around the electrical cord to plug connection.

3. The electrical cord to plug tension relief adaptor and wire saver/protector according to claim 1, wherein said pivot means comprises:

a pivot pin having a first end, an opposite second end, a diameter, and a head flange disposed near said first end;

a hollow collar shank having a first end, an opposite second end, and a head flange disposed at said second end, said hollow collar shank having a diameter slightly larger that said pivot pin;

said hollow collar shank being inserted into said axial through hole of said cams from the top of said cams, said pivot pin being inserted into said axial through hole of said cam from the bottom of said cams such that said second end of said pivot pin extends through said hollow collar shank and beyond said top of said cam and said second end of said collar shank, said second end of said pivot pin being inserted into said support post in said housing, and said first end of said pivot pin being inserted into said oppositely disposed female receiving slot.

4. The electrical cord to plug tension relief adaptor and wire saver/protector according to claim 3, wherein said end flange of said pivot pin maintains said pivot pin position within said support post and enables the rotation of said cam about said pivot pin, and said end flange of said hollow collar shank further enables the rotation of said cam.

5. The electrical cord to plug tension relief adaptor and wire saver/protector according to claim 4, wherein said second end of said pivot pin is knurled to provide a snug releasable fit between said receiving slot and said pivot pin.

6. The electrical cord to plug tension relief adaptor and wire saver/protector according to claim 1, wherein said pivot means also aids in the securing of said two housing halves with each other.

7. The electrical cord to plug tension relief adaptor and wire saver/protector according to claim 2, wherein said securing means comprises:

a harness head plate having slots for receiving the prongs of the plug and at least two cable straps extending therefrom, said cable straps having two opposite sides, said harness head plate having a predetermined shape corresponding to the shape of the plug;

securing slots molded into said housing halves for receiving said at least two cable straps; and whereby the plug is disposed in the plug seating head of the housing and said slots in said harness head plate are fitted around the prongs of the plug such that said at least two cable straps fit into said securing slots and secure the plug within said housing.

8. The electrical cord to plug tension relief adaptor and wire saver/protector according to claim 7, wherein said harness head plate is adjustable to fit more that one type of plug.

9. The electrical cord to plug tension relief adaptor and wire saver/protector according to claim 1, further comprising at least two distinct threading paths for the electrical cord through said plurality of cams in said housing, the electrical cord frictionally engaging the outer edges of said cams when threaded through said cams, said at least two threading paths being determined by the thickness (gauge) of the electrical cord.

10. The electrical cord to plug tension relief adaptor and wire saver/protector according to claim 9, wherein said outer edges of said cams are textured to increase the frictional contact between said plurality of cams and the electrical cord.

11. The electrical cord to plug tension relief adaptor and wire saver/protector according to claim 7, wherein each of said at least two cable straps have locking ridges disposed on at least one of said opposite sides, said locking ridges engaging said securing slots.

* * * * *